US007275598B2

(12) United States Patent
Steele

(10) Patent No.: US 7,275,598 B2
(45) Date of Patent: Oct. 2, 2007

(54) UNCOLLAPSED EXPANDABLE WELLBORE JUNCTION

(75) Inventor: David J. Steele, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 351 days.

(21) Appl. No.: 10/836,431

(22) Filed: Apr. 30, 2004

(65) Prior Publication Data

US 2005/0241830 A1 Nov. 3, 2005

(51) Int. Cl.
*E21B 43/14* (2006.01)

(52) U.S. Cl. ..... 166/313; 166/380; 166/381

(58) Field of Classification Search ..... 166/313, 166/187, 380, 381, 117.6, 207
See application file for complete search history.

(56) References Cited

U.S. PATENT DOCUMENTS

| | | | | |
|---|---|---|---|---|
| 2,420,226 | A * | 5/1947 | Claus | 277/341 |
| 2,658,891 | A * | 10/1953 | Toelke | 166/63 |
| 3,035,639 | A * | 5/1962 | Brown et al. | 166/150 |
| 3,353,599 | A | 11/1967 | Swift | |
| 5,388,648 | A | 2/1995 | Jordan, Jr. | |
| 5,979,560 | A | 11/1999 | Nobileau | |
| 6,056,059 | A | 5/2000 | Ohmer | |
| 6,070,671 | A * | 6/2000 | Cumming et al. | 166/381 |
| 6,089,320 | A * | 7/2000 | LaGrange | 166/313 |
| 6,135,208 | A * | 10/2000 | Gano et al. | 166/313 |
| 6,253,852 | B1 | 7/2001 | Nobileau | |
| 6,336,507 | B1 | 1/2002 | Collins | |
| 6,446,717 | B1 * | 9/2002 | White et al. | 166/187 |
| 6,814,147 | B2 * | 11/2004 | Baugh | 166/313 |
| 2001/0045289 | A1 * | 11/2001 | Cook et al. | 166/380 |
| 2004/0231861 | A1 * | 11/2004 | Whanger et al. | 166/387 |

FOREIGN PATENT DOCUMENTS

| | | |
|---|---|---|
| WO | WO99/13195 | 3/1999 |
| WO | WO 02/29207 | 4/2002 |
| WO | WO 02/29208 | 4/2002 |

OTHER PUBLICATIONS

Oil & Gas Journal's International Multilateral Well Conference, " The expandable, Intelligent Multilateral Well", Mar. 5-7, 2002.
Schlumberger, "RapidConnect Multilateral Completion System", Jan. 2002.
Drilling Contractor, "World's first Level 6 Intelligent completion drilled", Mar./Apr. 2003.
Baker Hughes, "Formation Junction System", undated.
SPE 67825: Evolution Toward Simpler, Less Risky Multilateral Wells , Feb. 2001.
SPE 68729: Erb West Field: The World's First Offshore Level 6 Multilateral Well , Apr. 2001.

* cited by examiner

*Primary Examiner*—Hoang Dang
(74) *Attorney, Agent, or Firm*—Marlin R. Smith

(57) ABSTRACT

An uncollapsed expandable wellbore junction and associated methods. In a described embodiment, a method of creating an expanded pressure vessel in a subterranean well includes the step of expanding the pressure vessel in the well, thereby increasing a dimension of the vessel, without prior decreasing of the dimension.

61 Claims, 11 Drawing Sheets

UNCOLLAPSED EXPANDABLE WELLBORE JUNCTION

BACKGROUND

The present invention relates generally to equipment utilized and operations performed in conjunction with a subterranean well and, in an embodiment described herein, more particularly provides an uncollapsed expandable wellbore junction.

It is known in the art to fabricate a wellbore junction, or another type of pressure vessel, at the surface and then collapse the junction so that it can be conveyed through a wellbore. When appropriately positioned in the wellbore, the junction is then expanded back to its originally fabricated configuration.

However, significant problems have been experienced with this method of expanding wellbore junctions. For example, the collapsing operation tends to work harden the material of which the junction is constructed, which makes the material less likely to exactly resume its expanded configuration in the well, and which makes the material more susceptible to corrosion and cracking in the wellbore environment. Critical areas of the junction, such as welds and tight radii areas, are subjected to very high stresses in the collapsing operation. Specialized and complex tooling, such as a built-for-purpose press, crushing mandrels and dies are needed for the collapsing operation.

Therefore, it may be seen that improved systems and methods are needed for fabricating and expanding wellbore junctions. These systems and methods would find application in creating other types of expandable pressure vessels, as well.

SUMMARY

In carrying out the principles of the present invention, in accordance with an embodiment thereof, an uncollapsed expandable pressure vessel is provided for use in a subterranean well. The described embodiment is a wellbore junction for interconnecting intersecting wellbores in the well. Associated methods are also provided.

In one aspect of the invention, a method of creating an expanded pressure vessel in a subterranean well includes the step of expanding the pressure vessel in the well, thereby increasing a dimension of the vessel, without prior decreasing of the dimension.

In another aspect of the invention, a method of creating an expanded pressure vessel in a subterranean well includes the steps of fabricating the vessel in an unexpanded configuration, without decreasing a dimension of the vessel; and then expanding the vessel in the well.

In yet another aspect of the invention a wellbore junction system for use in a subterranean well is provided. The system includes a wellbore junction expanded outwardly in the well from an unexpanded and uncollapsed configuration.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
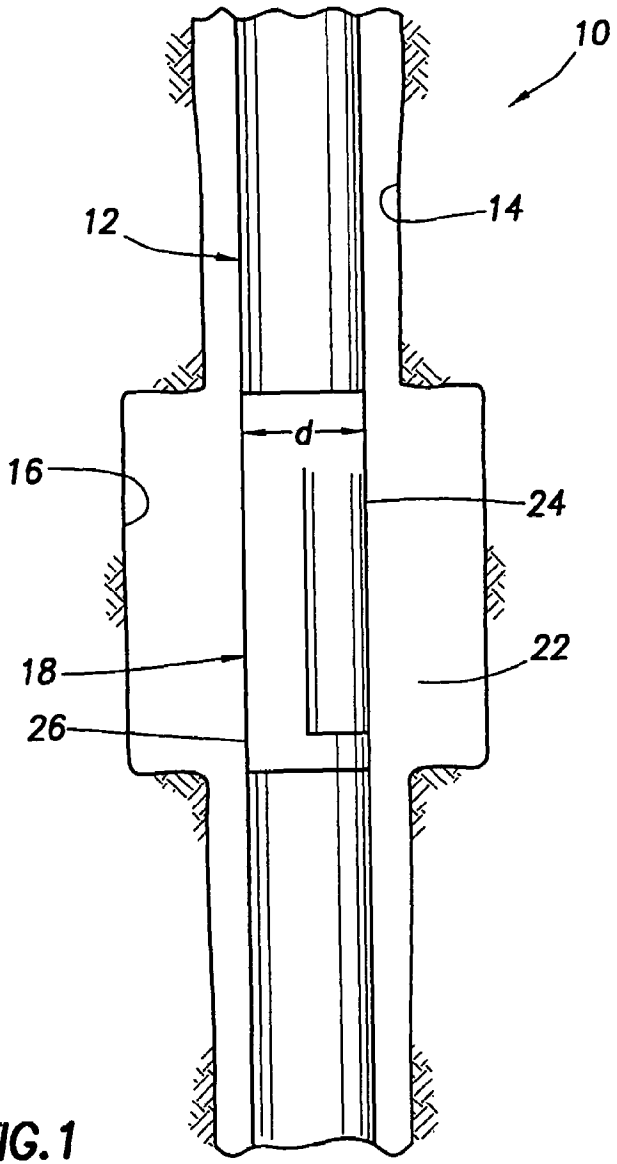
FIG. 1 is a schematic partially cross-sectional view of a wellbore junction system and associated method embodying principles of the present invention.

Representatively illustrated in FIG. 1 is a wellbore junction system 10 and associated method of creating an expanded pressure vessel, which embody principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

As depicted in FIG. 1, a casing string 12 has been conveyed into a wellbore 14. The wellbore 14 is illustrated as being uncased both above and below a radially enlarged cavity 16 formed in the wellbore, for example, by underreaming. However, any portion of the wellbore 14 could be cased or otherwise lined prior to conveying the casing string 12 into the wellbore, and it is not necessary for the cavity 16 to be formed in the wellbore. Furthermore, the casing string 12 could be another type of tubular string, such as a liner string or tubing string, etc.

A wellbore junction 18 is interconnected in the casing string 12. The junction 18 is positioned in the cavity 16, so that when the junction is later expanded, it can extend outward beyond the wellbore 14 as originally drilled. However, note that if it is not desired to extend the junction 18 in its expanded configuration beyond the wellbore 14 as originally drilled, then the cavity 16 may not be formed in the wellbore.

It should be clearly understood that the junction 18 is described herein as merely one example of a pressure vessel which may be expanded in a well. Any other type of pressure vessel having a pressure-bearing wall could be used in keeping with the principles of the invention. The vessel may be used for any purpose, such as for downhole storage, for separation of petroleum fluids and water, for downhole manufacturing, etc.

The junction 18 is used in the system 10 to interconnect the wellbore 14 to another wellbore 20 (see FIG. 2) which will intersect the first wellbore 14. The wellbore 20 could be drilled before or after the junction 18 is positioned at an intersection 22 between the wellbores 14, 20. Because of the various unique features of the junction 18 described below, the junction has a much improved capability of withstanding pressure differentials applied across its pressure-bearing walls at the intersection 22.

Figure 2:
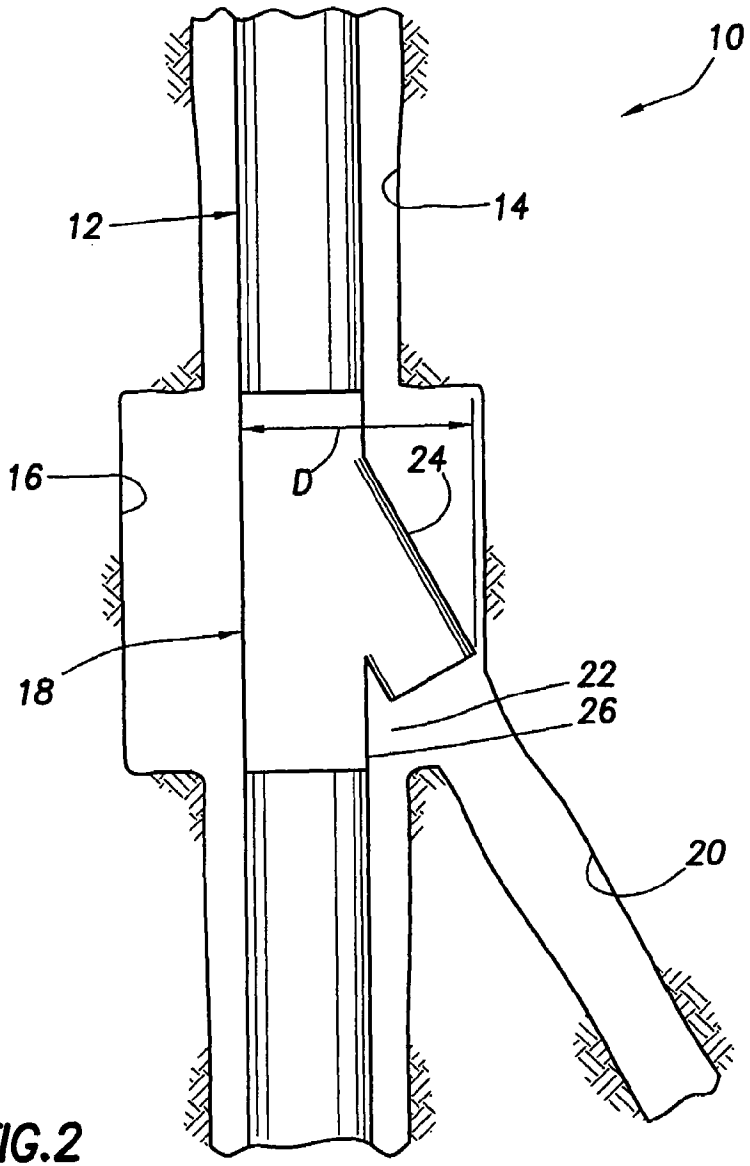
FIG. 2 is a schematic partially cross-sectional view of the system and method of FIG. 1, in which further steps of the method have been performed.

In the system 10 as depicted in FIGS. 1 & 2, the wellbore 14 is drilled first, so that it extends above and below the intersection 22. The wellbore junction 18 is then positioned at the intersection 22, and the junction is expanded. Then, the wellbore 20 is drilled outwardly from the intersection 22 through a leg 24 of the junction 18. Another leg 26 of the junction 18 extends downwardly inline with the wellbore 14 and is connected to a portion of the casing string extending downwardly into the wellbore below the cavity 16.

Alternatively, the junction 18 could be positioned at a lower end of the wellbore 14. The junction 18 could then be expanded, and intersecting wellbores could be drilled through each of the legs 24, 26. One or neither of these wellbores could be inline with the wellbore 14 above the junction 18.

Although the junction 18 is depicted as having only two downwardly extending legs 24, 26, it will be appreciated that any number of legs could be provided in the junction. For example, the junction 18 could have three, four or more legs. The legs could be laterally inline with each other, or they could be longitudinally spaced apart and/or radially distributed in the junction 18.

In one important aspect of the invention, the junction 18 is conveyed into the wellbore 14 in an unexpanded configuration (as depicted in FIG. 1), without having been previously collapsed. In this way, the technical difficulties, metallurgical problems and extreme stresses of the collapsing operation are avoided. Instead, the junction 18 is originally fabricated in its unexpanded configuration, conveyed into the wellbore 14, and then expanded to its expanded configuration for the first time.

Thus, the junction 18 has an outer dimension d at the time it is conveyed into the wellbore 14. After being expanded in the wellbore 14, the junction 18 has an enlarged outer dimension D. Instead of fabricating a junction so that it originally has the outer dimension D, then collapsing the junction so that it has the outer dimension d, conveying it into a wellbore, and then expanding the junction so that it again has the outer dimension D (as was done in the prior art), the junction 18 is fabricated so that it has the outer dimension d in its original configuration.

The width dimensions d and D are given as examples of dimensions that may be expanded. Other dimensions that could be expanded include cross-sectional area, circumference, diameter, length, etc. Any dimension of a vessel can be expanded in keeping with the principles of the invention.

Preferably, the junction 18 is expanded by applying a pressure differential across a pressure-bearing wall of the junction to thereby inflate the junction. One or more plugs may be provided for one or both of the legs 24, 26, so that pressure can be applied via the casing string 12 above the junction 18 to inflate the junction. Alternatively, the junction 18 could be expanded by other methods, such as by mechanically swaging or drifting, etc. Furthermore, the junction 18 could be expanded by a combination of methods, such as by combined inflation and mechanical forming (e.g., swaging or drifting). In that case, preferably the junction 18 would be expanded by inflating the junction (either directly, or via a membrane or bladder positioned inside the junction, etc.), and then the junction would be further expanded or "sized" to a certain desired shape by mechanical forming.

The junction 18 may be cemented in the wellbore 14 and cavity 16 either with, or separately from, the remainder of the casing string 12. For example, the casing string 12 could be cemented in the wellbore 14 prior to drilling the branch wellbore 20, then the junction 18 could be cemented in the cavity 16 after a liner string (not shown) is positioned in the branch wellbore and sealingly secured to the leg 24. The leg 24 could have a seal bore therein, such as a polished bore receptacle (PBR), for sealing engagement with the liner string.

The junction 18 may also be provided with conventional internal orienting profiles and latching profiles for rotationally orienting the junction relative to the branch wellbore 20, for anchoring and orienting whipstocks and other deflectors, etc.

Figure 3:
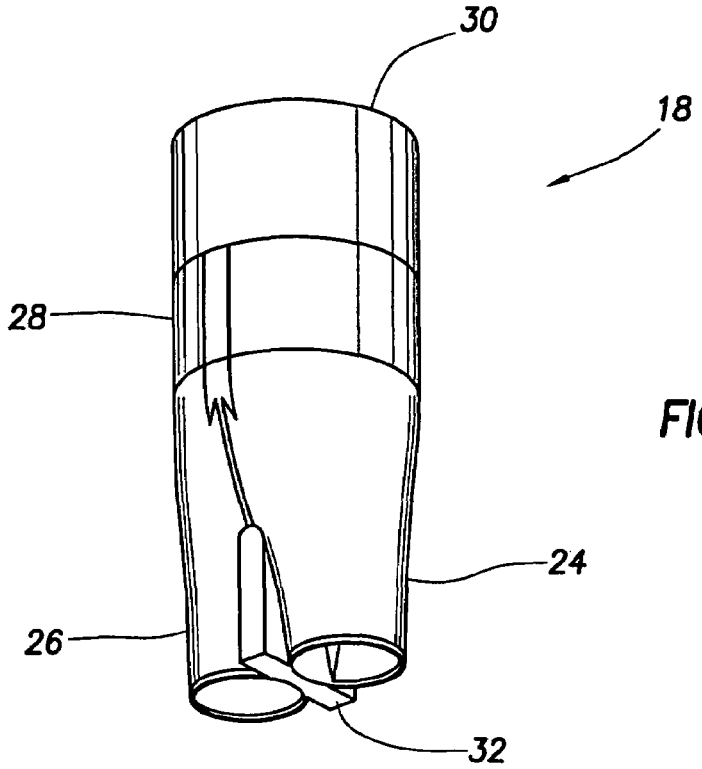
FIG. 3 is a schematic isometric view of a wellbore junction used in the system and method of FIGS. 1 & 2, the wellbore junction embodying principles of the invention.

Referring additionally now to FIG. 3, a middle portion 28 of the junction 18 is representatively illustrated in its expanded configuration apart from the remainder of the system 10. In this view it may be seen that the middle portion 28 of the junction 18 forms an intersection between an upper generally cylindrical body 30 and each of the lower legs 24, 26. This intersection is strengthened, and its fabrication is facilitated, by a stiffener 32 interposed between the legs 24, 26 and body 30 at the intersection, which is described in more detail below.

Figure 4:
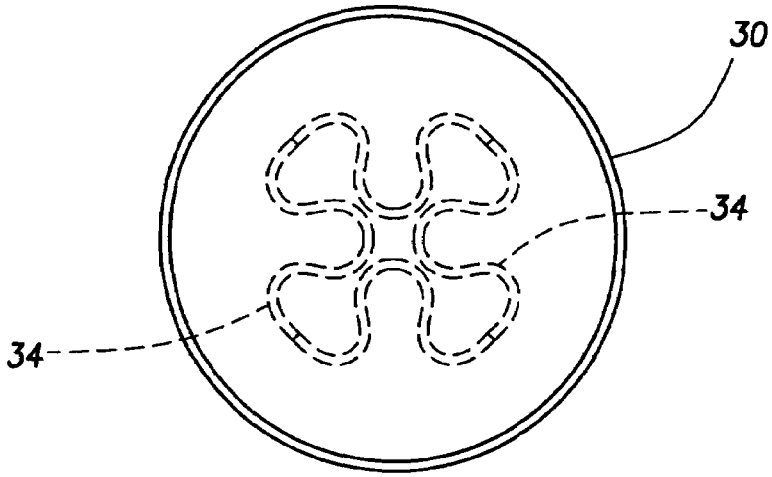
FIG. 4 is a top view of the wellbore junction, showing an upper end of the junction in unexpanded and expanded configurations.

A top view of the body 30 is depicted in FIG. 4. The expanded configuration of the body 30 is shown in solid lines. An unexpanded, cloverleaf-shaped, configuration of the body 30 is shown in dashed lines. Note that the body 30 is originally fabricated in the unexpanded configuration, rather than being collapsed or crushed from its expanded configuration.

Figure 5:
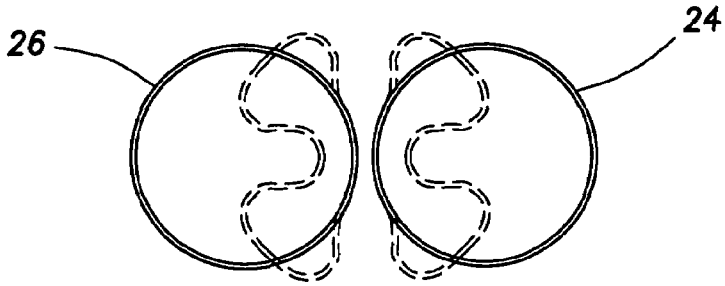
FIG. 5 is a bottom view of the wellbore junction, showing a lower end of the junction in unexpanded and expanded configurations.

A bottom view of the legs 24, 26 is depicted in FIG. 5. The expanded configurations of the legs 24, 26 are shown in solid lines. An unexpanded, partial cloverleaf-shaped, configuration of each of the legs 24, 26 is shown in dashed lines. Again, the legs 24, 26 are originally fabricated in the unexpanded configurations.

The unexpanded configurations of the body 30 and legs 24, 26 (and other portions of the junction 18) are fabricated using techniques which reduce stresses in the various junction portions due to the fabrication process. For example, in FIG. 6, a portion 34 of the junction 18 is shown being folded or bent greater than 180 degrees between a cylindrical die 36 and an elastomeric pad 38, without overstressing the material. This operation can be performed on a conventional brake press, with very little need for specialized equipment, unlike prior methods of crushing wellbore junctions in a built-for-purpose press.

Figure 7:
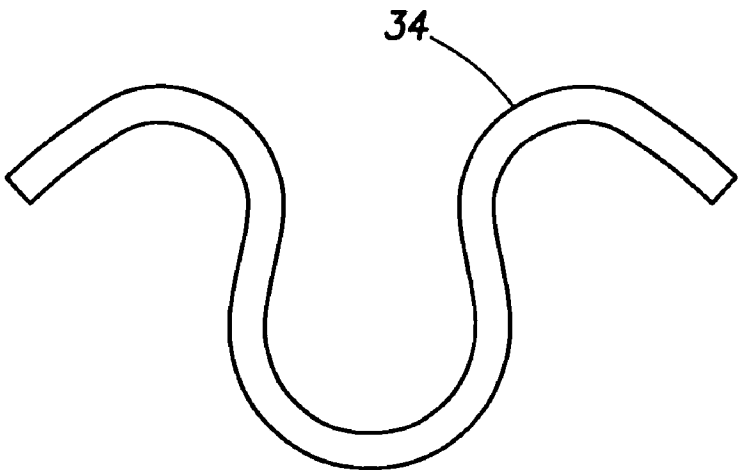
FIG. 7 is a cross-sectional view of a portion of the wellbore junction formed according to the method of FIG. 6.
Figure 6:
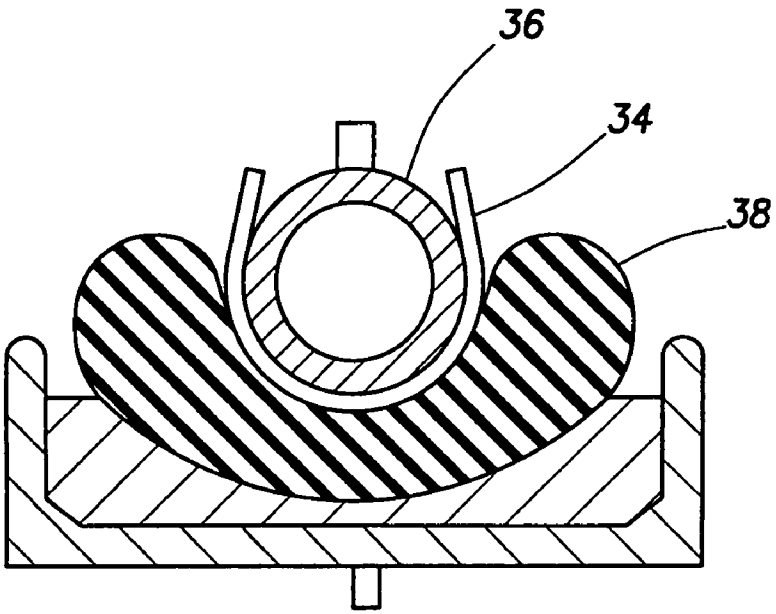
FIG. 6 is a side view showing a method of forming portions of the wellbore junction.

In FIG. 7, an end view of the junction portion 34 is shown after opposite sides of the portion have been folded over in an operation similar to that shown in FIG. 6. By welding together four of the portions 34, the cloverleaf-shaped unexpanded configuration of the body 30 may be fabricated, as shown in FIG. 4. This cloverleaf-shaped configuration is achieved without overstressing the material, allowing the body 30 to be fabricated in a smaller space (having smaller outer dimensions) than in previous wellbore junctions. Similarly, other portions of the junction 18 may be fabricated by bending, folding or otherwise partially collapsing multiple individual pieces, and then interconnecting the pieces to each other, or to other uncollapsed pieces.

Note that welding may be used to interconnect pieces or portions of the junction 18 to each other when those elements are made of metal, but other methods may be used if desired. For example, fasteners, adhesives, explosive bonding, etc. could be used instead of, or in addition to, welding.

If the elements are made of non-metallic materials, such as composites or combinations of metals and composites, then other methods may also be used.

The process of fabricating the junction 18 in its unexpanded configuration is illustrated in FIGS. 8-17. However, it should be understood that these figures merely depict one example of a wide variety of methods which may be used to fabricate an expandable pressure vessel according to the principles of the invention. Thus, the invention is not limited to the specific details of this one example described below.

Figure 8:
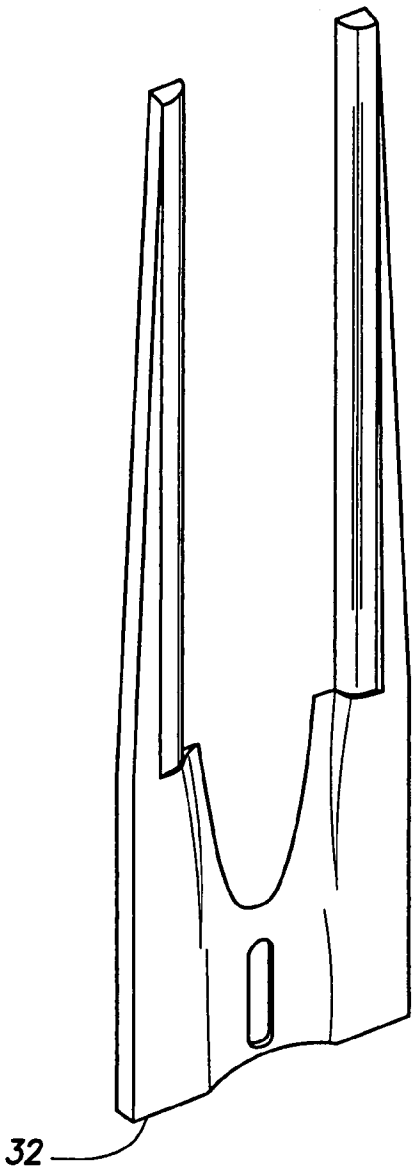
FIG. 8 is an isometric view of an initial step in a method of fabricating the wellbore junction.

In FIG. 8, it may be seen that the basic starting point in fabricating the junction 18 is the stiffener 32. This provides a foundation on which the intersection between the body 30 and legs 24, 26 is formed. Preferably, the stiffener 32 is fabricated in at least two pieces and then joined together, for example, by welding. The stiffener 32 could be fabricated in one piece, however, in keeping with the principles of the invention.

Figure 9:
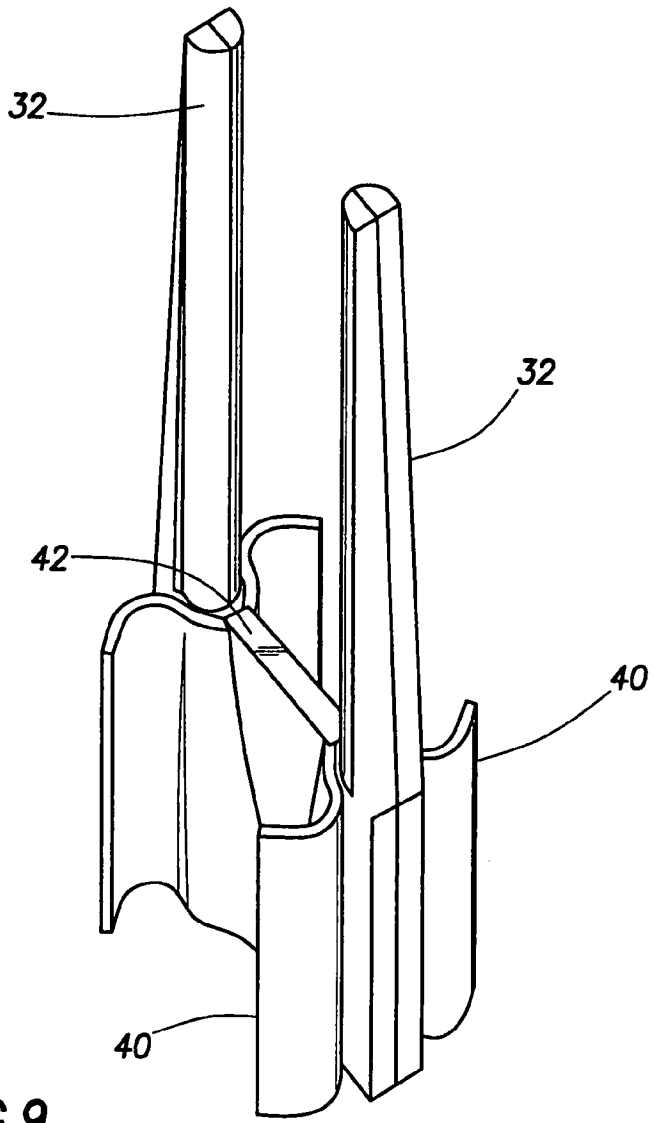
FIGS. 9-17 are isometric views of intermediate steps in the method of fabricating the wellbore junction.

In FIG. 9, two inner upper portions 40 of the legs 24, 26 are attached on opposite sides of the stiffener 32. A plate 42 is attached to the stiffener 32 and to each of the portions 40.

Figure 10:
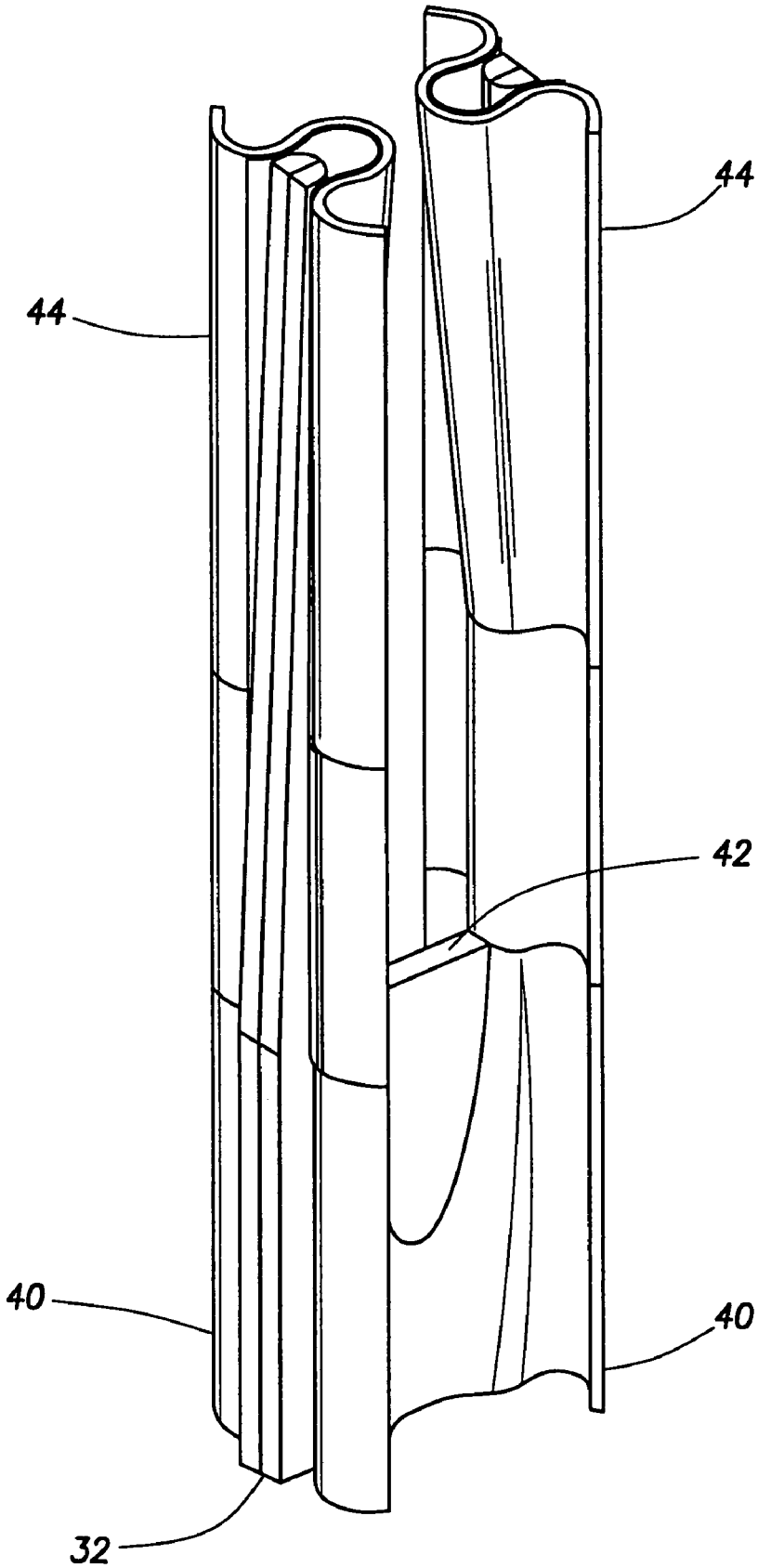

In FIG. 10, two inner lower portions 44 of the body 30 are attached within the stiffener 32. The portions 44 are also welded to the portions 40.

Figure 11:
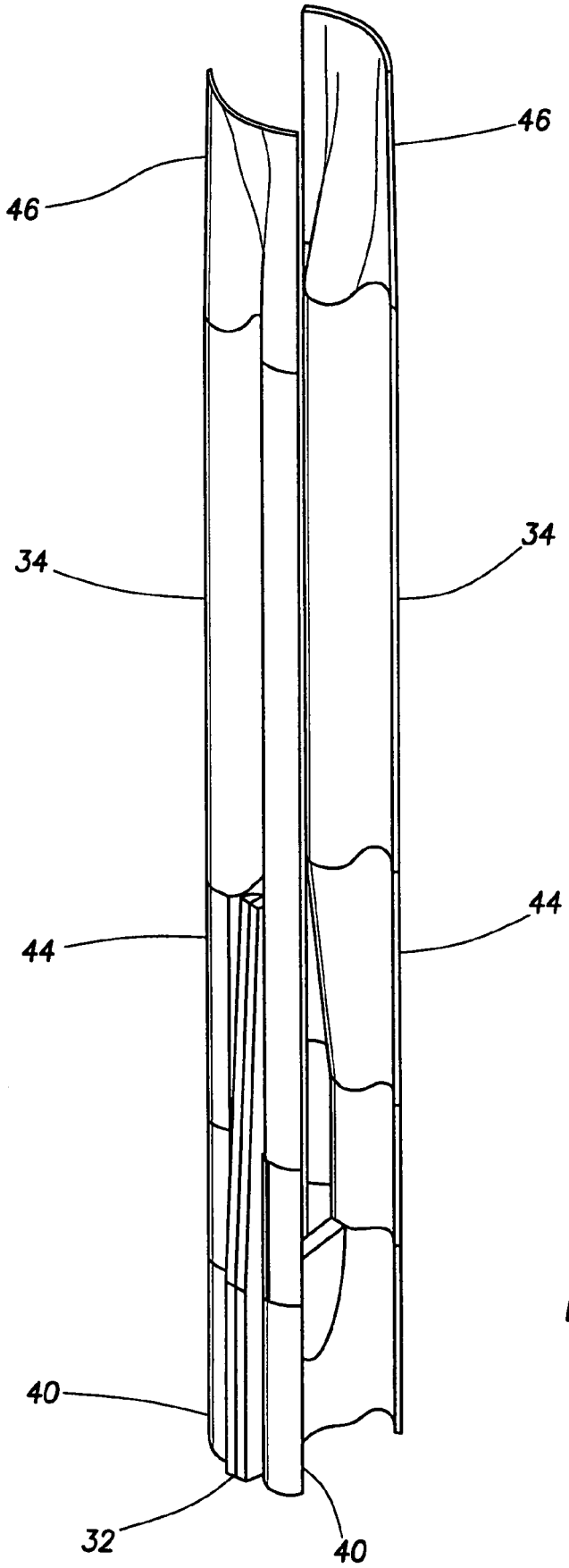

In FIG. 11, two of the portions 34 of the body 30 are attached above the portions 44. Two upper body portions 46 are attached above the portions 34. The upper body portions 46 provide a transition from the cloverleaf-shaped cross-section of the body 30 shown in FIG. 4 (formed by the portions 34) to the cylindrical shape needed for connection of the junction 18 to the casing string 12 above the junction.

Figure 12:
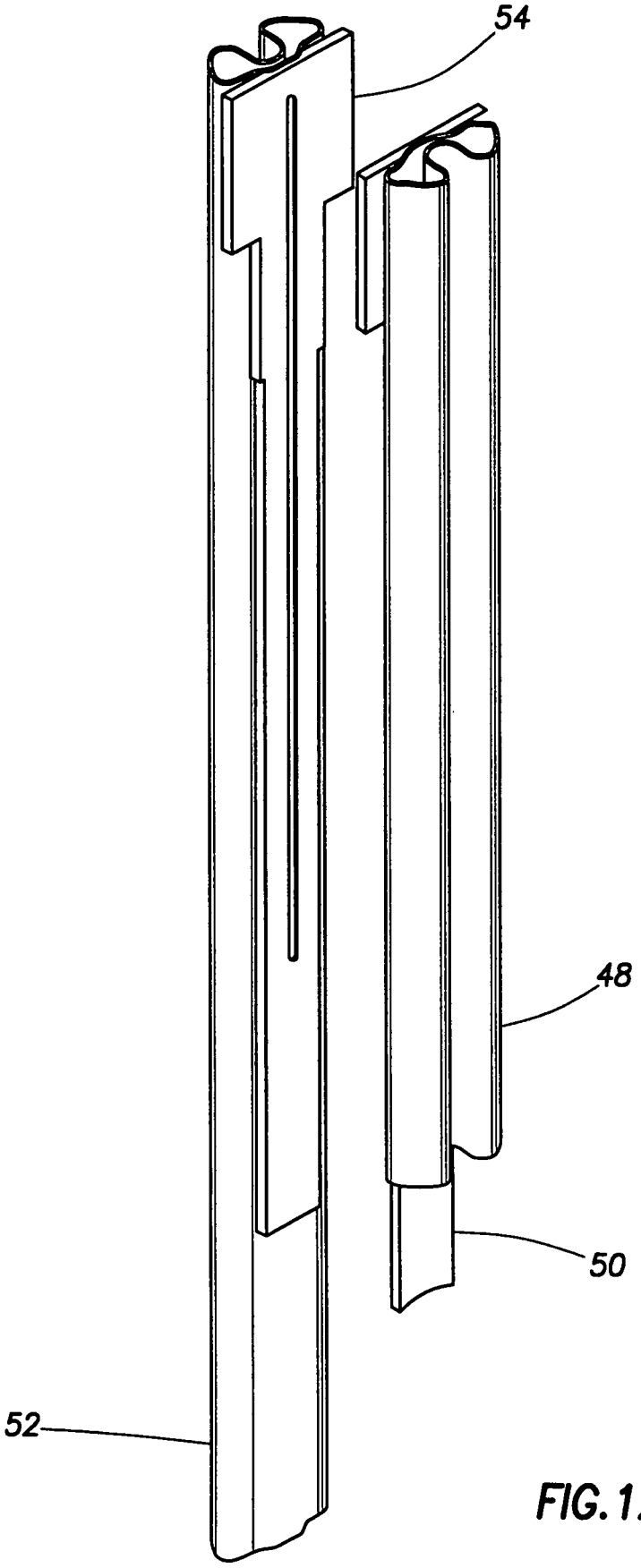

In FIG. 12, a middle portion 48 of the leg 24 is attached to a stiffening base 50. A middle portion 52 of the leg 26 is attached to another stiffening base 54. The middle leg portions 48, 52 may be made up of only one piece each, or they may be made up of multiple interconnected pieces. The two bases 50, 54 are attached to each other after the portions 48, 52 are attached to the bases.

Figure 13:
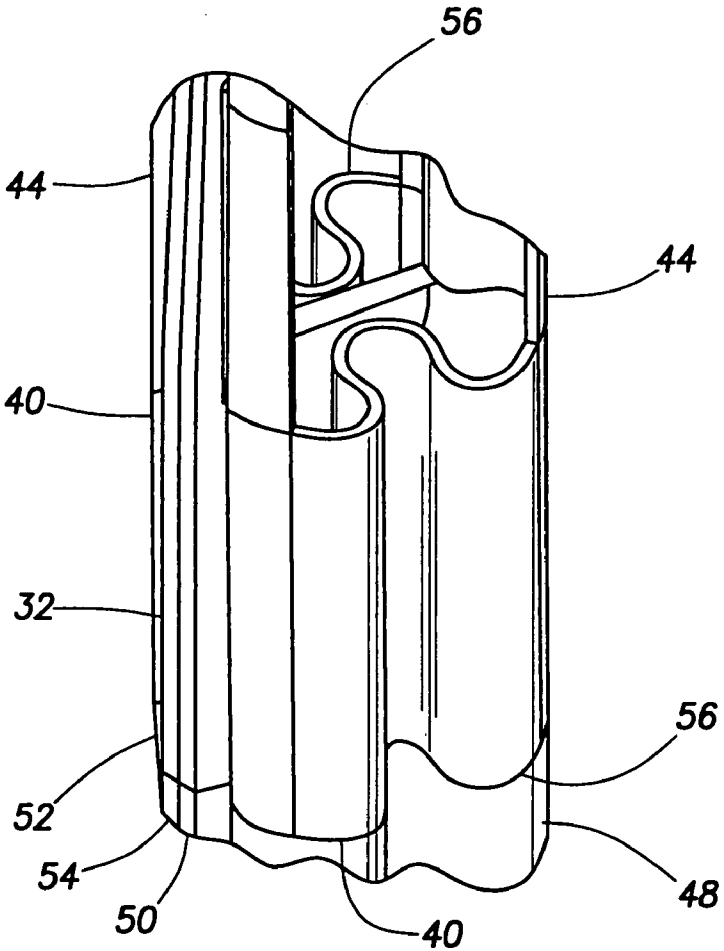

In FIG. 13, the bases 50, 54 are shown attached to each other. The bases 50, 54 are then attached to a lower end of the stiffener 32. Each of the middle leg portions 48, 52 is attached to a lower end of one of the inner leg portions 40. Then, two outer upper leg portions 56 are attached to the inner leg portions 40, thereby enclosing the upper ends of the legs 24, 26 at their intersection with the body 30.

Figure 14:
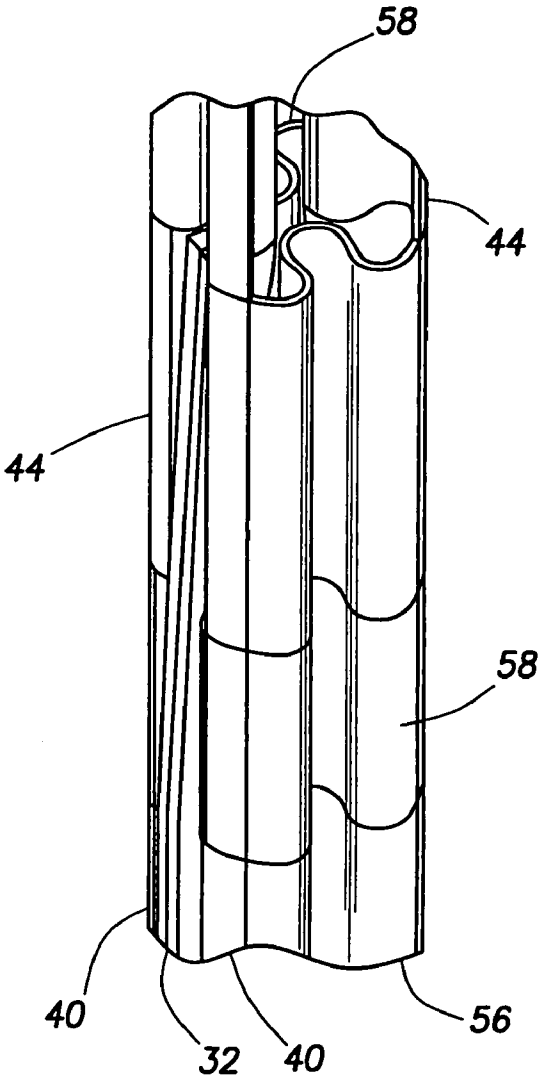

In FIG. 14, two more lower body portions 58 are attached to the portions 44, thereby enclosing the lower end of the body 30 at its intersection with the legs 24, 26.

Figure 15:
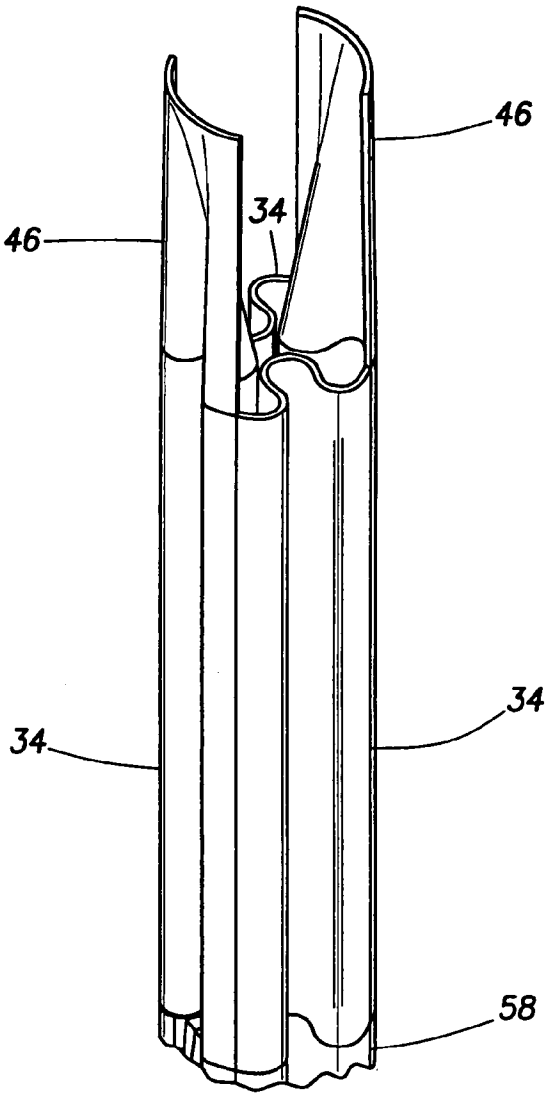

In FIG. 15, two more middle body portions 34 are attached to the previous two portions 34. This encloses the middle of the body 30 and forms the completed cloverleaf-shaped unexpanded configuration shown in FIG. 4.

Figure 16:
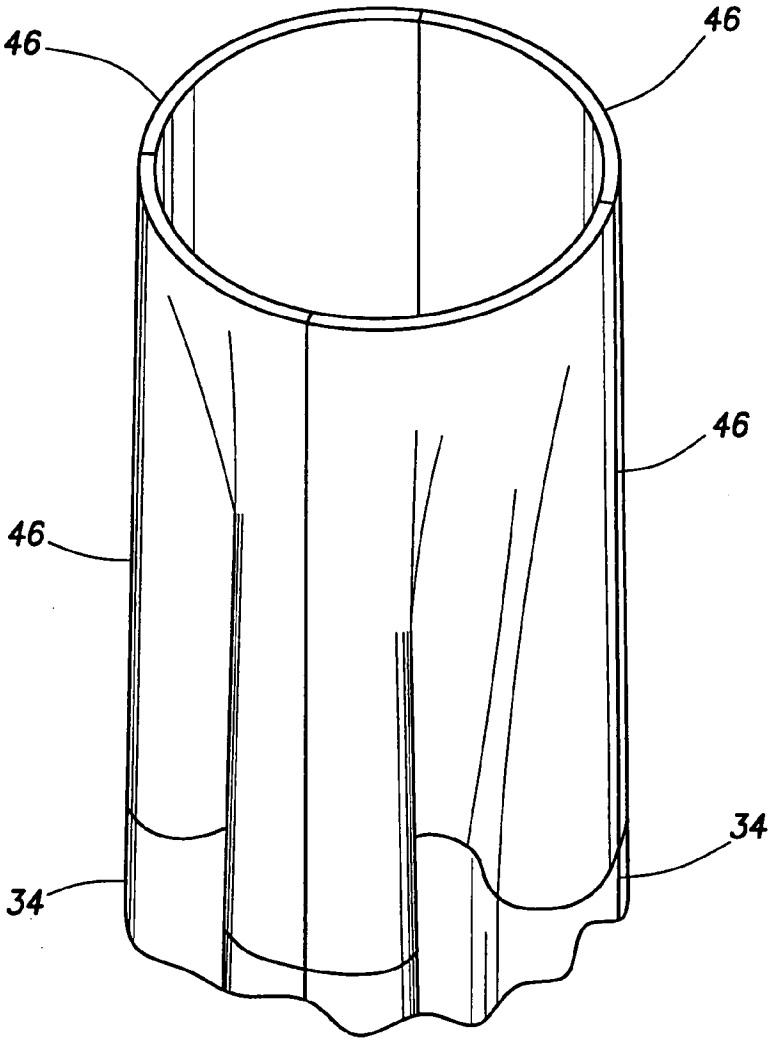

In FIG. 16, two more of the upper body portions 46 are attached to the previous two portions 46. This encloses the upper end of the body 30 and forms a cylindrical shape at the top of the body to facilitate connecting to the casing string 12 above the junction 18.

Figure 17:
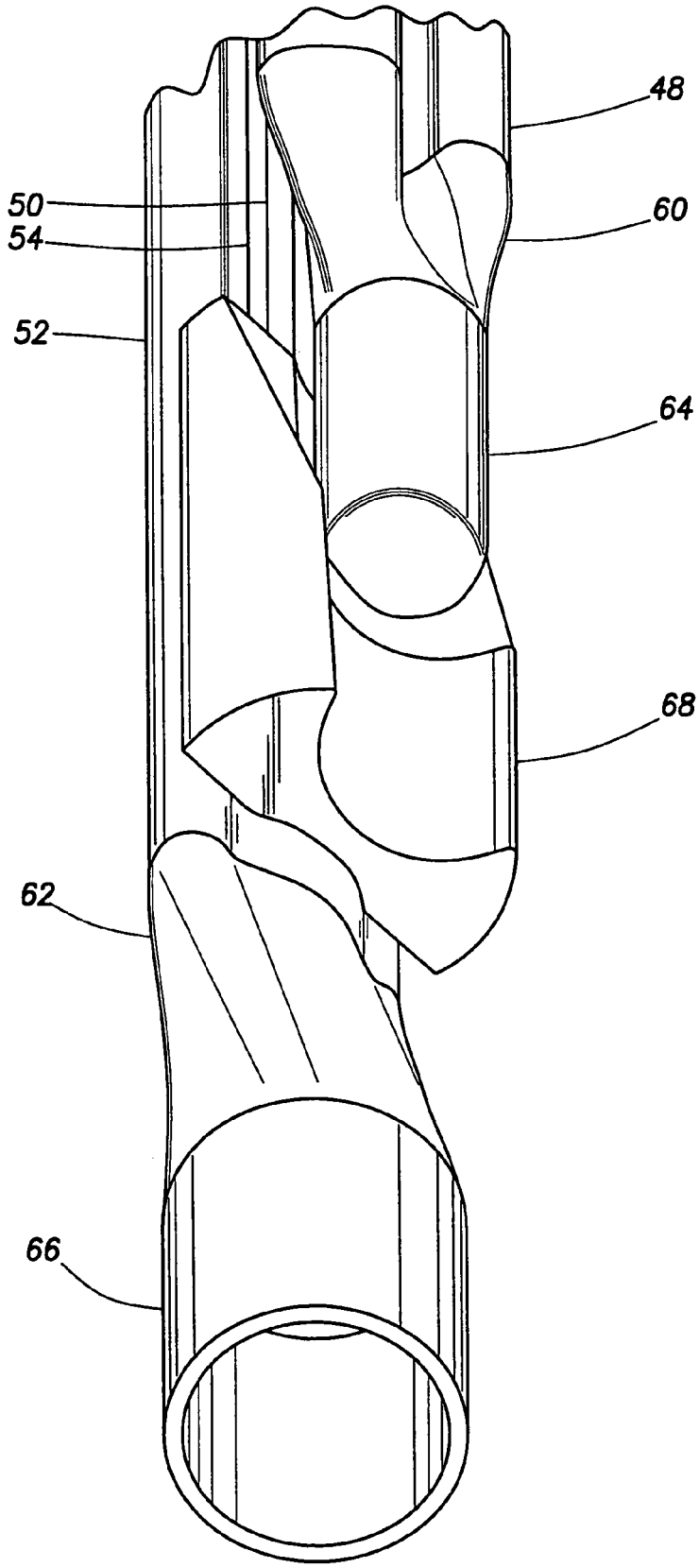

In FIG. 17, lower ends of the legs 24, 26 are shown. A transition piece 60 is attached at a lower end of the leg portion 48, and a transition piece 62 is attached at a lower end of the leg portion 52. The transition piece 60 provides a transition between the unexpanded configuration of the leg portion 48 and a configuration of a plug 64 at the lower end of the leg 24. The plug 64 prevents pressure from escaping through the leg 24 when the junction 18 is inflated. The plug 64 is drilled out later (after the expansion process) when the wellbore 20 is drilled.

The transition piece 62 provides a transition between the unexpanded configuration of the leg portion 52 and a cylindrical generally tubular configuration of a lower casing connection 66. The connection 66 may be threaded for connecting the casing string 12 below the junction 18.

A deflector 68 is attached to lower ends of the bases 50, 54. The deflector 68 ensures that cutting tools (such as mills, drills, etc.) conveyed through the leg 24 after expansion of the junction 18 are deflected away from the other leg 26.

Figure 18:
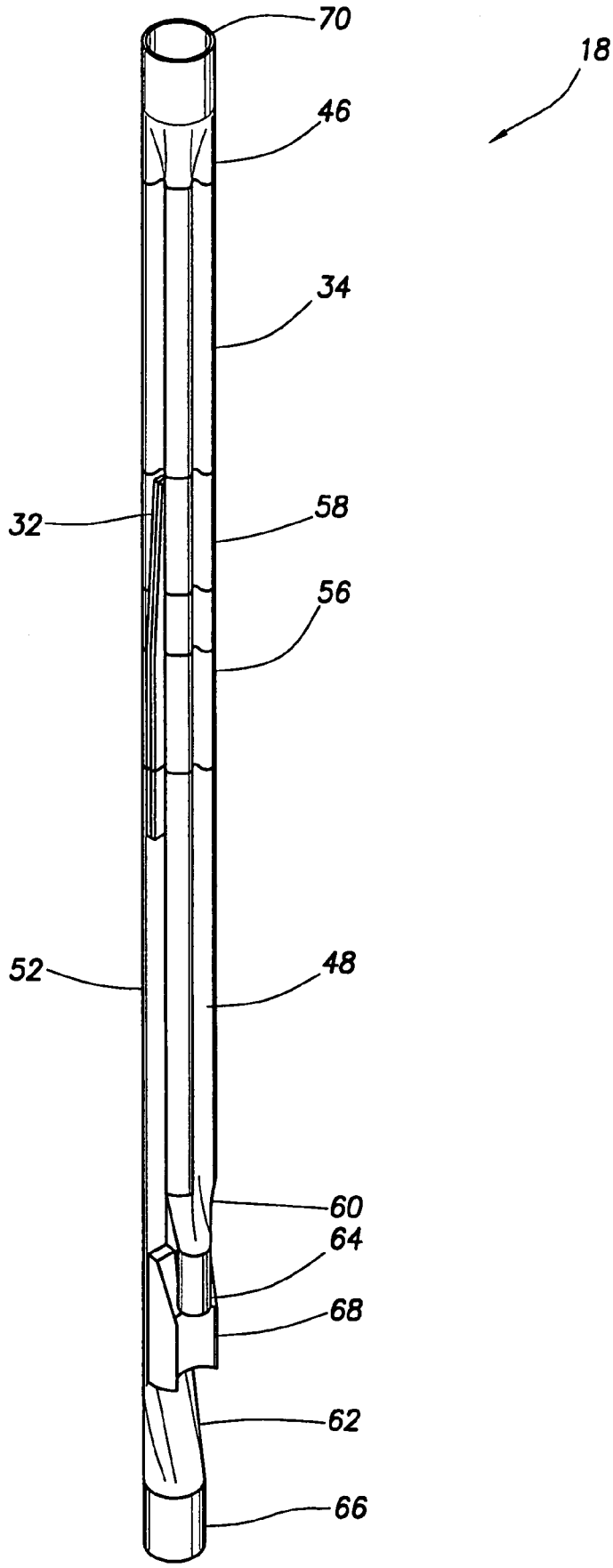
FIG. 18 is an isometric view of the fabricated wellbore junction in its unexpanded and uncollapsed configuration.

The completed junction 18 is shown in FIG. 18. Note that an upper casing connector 70 is attached above the interconnected upper body portions 46. The connector 70 may be threaded to provide for connecting the junction 18 to the casing string 12 above the junction.

The interconnected portions of the body 30 and legs 24, 26 form pressure-bearing walls of the junction 18. Thus, the junction 18 is a pressure vessel which is fabricated in an original unexpanded configuration. It will be readily appreciated that, when a pressure differential is applied from the interior to the exterior of the pressure-bearing walls of the junction 18, that the junction will expand or inflate to its expanded configuration as depicted in FIG. 2.

The expansion process will include unfolding, unbending or otherwise uncollapsing or enlarging various portions making up the junction 18. For example, the folded or unextended shape of the portions 34 will take on the cylindrical shape of the body 30, as depicted in FIG. 4.

Note that this expansion process preferably does not include any, or any substantial, lengthening of a perimeter or circumferential stretching of the walls of the junction 18. Thus, there is preferably no, or no substantial, decrease in the wall thickness of the junction 18 due to the expansion process. For example, the perimeter length of the body 30 in the cloverleaf-shaped unexpanded configuration shown in dashed lines in FIG. 4 is preferably the same as the perimeter length of the body in the cylindrical expanded configuration shown in solid lines. The same is preferably true of the unexpanded and expanded configurations of the legs 24, 26 as depicted in FIG. 5.

Of course, a person skilled in the art would, upon a careful consideration of the above description of a representative embodiment of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of creating an expanded pressure vessel in a subterranean well, the method comprising the steps of:

fabricating the vessel with a deflector positioned to prevent a cutting tool displaced through a first portion of the vessel from cutting into a second portion of the vessel; and expanding the pressure vessel in the well, thereby increasing a dimension of the vessel, without prior decreasing of the dimension.

2. The method of claim 1, further comprising the step of fabricating the vessel in an original unexpanded configuration.

3. The method of claim 2, wherein the fabricating step is performed without decreasing of the dimension.

4. The method of claim 2, wherein the fabricating step includes providing the vessel with a pressure-bearing wall.

5. The method of claim 1, wherein the expanding step further comprises applying a fluid pressure differential across a pressure-bearing wall of the vessel.

6. The method of claim 1, wherein the expanding step further comprises mechanically forming a wall of the vessel.

7. The method of claim 6, wherein the expanding step further comprises applying a fluid pressure differential across a pressure-bearing wall of the vessel.

8. The method of claim 1, wherein the vessel is a wellbore junction for interconnecting intersecting wellbores in the well.

9. The method of claim 1, further comprising the step of positioning the vessel at a wellbore intersection in the well.

10. The method of claim 1, further comprising the step of fabricating the vessel by at least partially collapsing multiple portions of the vessel, and then interconnecting the vessel portions.

11. The method of claim 10, wherein the expanding step further comprises enlarging the interconnected vessel portions.

12. The method of claim 10, wherein the collapsing step further comprises bending a plurality of the vessel portions greater than 180 degrees.

13. The method of claim 10, wherein the collapsing step further comprises bending a plurality of the vessel portions in multiple places.

14. The method of claim 1, further comprising the step of fabricating the vessel with a stiffener interconnecting multiple portions of the vessel.

15. The method of claim 14, wherein in the expanding step the stiffener is not expanded.

16. A method of creating an expanded pressure vessel in a subterranean well, the method comprising the steps of:

fabricating the vessel in an unexpanded configuration, without decreasing a dimension of the vessel; and then expanding the vessel in the well, the expanding step being performed without circumferentially stretching a wall of the vessel.

17. The method of claim 16, wherein the fabricating step further comprises fabricating the vessel so that the unexpanded configuration is an original configuration of the fabricated vessel.

18. The method of claim 16, wherein the fabricating step further comprises forming at least one portion of the vessel in an unextended configuration, and wherein the expanding step further comprises forcing the vessel portion to an extended configuration.

19. The method of claim 18, wherein the forcing step further comprises increasing the dimension of the vessel.

20. The method of claim 16, wherein the fabricating step further comprises forming multiple vessel portions, the vessel portions being in an unextended configuration, and then interconnecting the vessel portions to each other.

21. The method of claim 20, wherein the expanding step further comprises forcing the vessel portions to an extended configuration.

22. The method of claim 16, wherein the expanding step is performed without decreasing a wall thickness of the vessel.

23. The method of claim 16, wherein the expanding step is performed without substantially decreasing a wall thickness of the vessel.

24. The method of claim 16, wherein the expanding step is performed without substantially increasing a perimeter length of the vessel.

25. The method of claim 16, wherein the expanding step is performed without substantially circumferentially stretching a wall of the vessel.

26. The method of claim 16, further comprising the step of forming an enlarged cavity in a wellbore of the well, and wherein the expanding step further comprises expanding the vessel within the enlarged cavity.

27. The method of claim 16, wherein the expanding step further comprises increasing the dimension of the vessel.

28. The method of claim 27, wherein the vessel dimension increasing step is performed without prior decreasing of the dimension.

29. The method of claim 16, wherein the fabricating step further comprises providing the vessel with a pressure-bearing wall.

30. The method of claim 16, wherein the expanding step further comprises applying a pressure differential across a pressure-bearing wall of the vessel.

31. The method of claim 16, wherein the expanding step further comprises mechanically forming a wall of the vessel.

32. The method of claim 31, wherein the expanding step further comprises applying a pressure differential across a pressure-bearing wall of the vessel.

33. The method of claim 16, wherein the vessel is a wellbore junction for interconnecting intersecting wellbores in the well.

34. The method of claim 16, further comprising the step of positioning the vessel at a wellbore intersection in the well.

35. The method of claim 34, wherein the positioning step is performed prior to forming the wellbore intersection in the well.

36. The method of claim 16, further comprising the step of fabricating the vessel by at least partially collapsing multiple portions of the vessel, and then interconnecting the vessel portions.

37. The method of claim 36, wherein the collapsing step is performed at least partially by folding the vessel portions.

38. The method of claim 36, wherein the expanding step further comprises enlarging the interconnected vessel portions.

39. The method of claim 38, wherein the enlarging step further comprises unfolding the vessel portions.

40. The method of claim 16, wherein the fabricating step further comprises fabricating the vessel with a stiffener interconnecting multiple portions of the vessel.

41. The method of claim 40, wherein in the expanding step the stiffener is not expanded.

42. The method of claim 16, wherein the fabricating step further comprises fabricating the vessel with a deflector positioned to prevent a cutting tool displaced through a first portion of the vessel from cutting into a second portion of the vessel.

43. A method of creating an expanded pressure vessel in a subterranean well, the method comprising the steps of:

fabricating the vessel in an unexpanded configuration, without decreasing a dimension of the vessel; and then expanding the vessel in the well, the expanding step being performed without increasing a perimeter length of the vessel.

44. A method of creating an expanded pressure vessel in a subterranean well, the method comprising the steps of:

fabricating the vessel in an unexpanded configuration, without decreasing a dimension of the vessel, the fabricating step further comprising bending multiple portions of the vessel greater than 180 degrees prior to attaching the vessel portions to each other; and then expanding the vessel in the well.

45. A method of creating an expanded pressure vessel in a subterranean well, the method comprising the steps of:

fabricating the vessel in an unexpanded configuration, without decreasing a dimension of the vessel, the fabricating step further comprising bending multiple portions of the vessel in multiple places prior to attaching the vessel portions to each other; and then expanding the vessel in the well.

46. A method of creating an expanded wellbore junction in a subterranean well, the method comprising the steps of:

fabricating the wellbore junction by at least partially collapsing multiple portions of the wellbore junction, and then interconnecting the wellbore junction portions; and expanding the wellbore junction in the well, thereby increasing a dimension of the wellbore junction, without prior decreasing of the dimension.

47. The method of claim 46, further comprising the step of fabricating the wellbore junction in an original unexpanded configuration.

48. The method of claim 47, wherein the fabricating step is performed without decreasing of the dimension.

49. The method of claim 47, wherein the fabricating step includes providing the wellbore junction with a pressure-bearing wall.

50. The method of claim 46, wherein the expanding step further comprises applying a fluid pressure differential across a pressure-bearing wall of the wellbore junction.

51. The method of claim 46, wherein the expanding step further comprises mechanically forming a wall of the wellbore junction.

52. The method of claim 51, wherein the expanding step further comprises applying a fluid pressure differential across a pressure-bearing wall of the wellbore junction.

53. The method of claim 46, wherein the wellbore junction interconnects intersecting wellbores in the well.

54. The method of claim 46, further comprising the step of positioning the wellbore junction at a wellbore intersection in the well.

55. The method of claim 54, wherein the positioning step is performed prior to forming the wellbore intersection.

56. The method of claim 46, wherein the expanding step further comprises enlarging the interconnected wellbore junction portions.

57. The method of claim 46, wherein the collapsing step further comprises bending a plurality of the wellbore junction portions greater than 180 degrees.

58. The method of claim 46, wherein the collapsing step further comprises bending a plurality of the wellbore junction portions in multiple places.

59. The method of claim 46, further comprising the step of fabricating the wellbore junction with a stiffener interconnecting multiple portions of the wellbore junction.

60. The method of claim 59, wherein in the expanding step the stiffener is not expanded.

61. The method of claim 46, further comprising the step of fabricating the wellbore junction with a deflector positioned to prevent a cutting tool displaced through a first portion of the wellbore junction from cutting into a second portion of the wellbore junction.

* * * * *